US010968844B2

(12) United States Patent
Braun et al.

(10) Patent No.: US 10,968,844 B2
(45) Date of Patent: Apr. 6, 2021

(54) METHOD FOR DETERMINING THE CURRENT COMPRESSION RATIO OF AN INTERNAL COMBUSTION ENGINE DURING OPERATION

(71) Applicant: Vitesco Technologies GMBH, Hannover (DE)

(72) Inventors: Tobias Braun, Undorf/Nittendorf (DE); Matthias Delp, Bad Abbach (DE); Frank Maurer, Regenstauf (DE)

(73) Assignee: Vitesco Technologies GmbH, Hannover (DE)

( * ) Notice: Subject to any disclaimer, the term of this patent is extended or adjusted under 35 U.S.C. 154(b) by 0 days.

(21) Appl. No.: 16/696,333

(22) Filed: Nov. 26, 2019

(65) Prior Publication Data

US 2020/0284212 A1 Sep. 10, 2020

Related U.S. Application Data

(63) Continuation of application No. PCT/EP2018/063565, filed on May 23, 2018.

(30) Foreign Application Priority Data

May 23, 2018 (DE) ..... 10 2017 209 112.6

(51) Int. Cl.
*F02D 41/28* (2006.01)
*F02D 35/02* (2006.01)
*F02D 41/00* (2006.01)

(52) U.S. Cl.
CPC ..... *F02D 35/023* (2013.01); *F02D 41/009* (2013.01); *F02D 41/28* (2013.01);
(Continued)

(58) Field of Classification Search
CPC ..... F02D 35/023; F02D 41/009; F02D 41/28; F02D 2041/288; F02D 2200/024;
(Continued)

(56) References Cited

U.S. PATENT DOCUMENTS 4,834,031 A * 5/1989 Katoh ..... F02B 75/04 123/48 R
4,836,015 A * 6/1989 Krage ..... G01L 23/08 702/140

(Continued)

FOREIGN PATENT DOCUMENTS

CN 106414965 A 2/2017
DE 102006033062 A1 1/2008

(Continued)

OTHER PUBLICATIONS

International Search Report and Written Opinion dated Aug. 13, 2018 from corresponding International Patent Application No. PCT/EP2018/063565.

(Continued)

*Primary Examiner* — David Hamaoui

(57) ABSTRACT

In the method according to example embodiments, dynamic pressure oscillations in the inlet tract of the respective internal combustion engine are measured during normal operation, and from these a corresponding pressure oscillation signal is generated. A crankshaft phase angle signal is acquired at the same time. The pressure oscillation signal is used to determine an actual value of at least one characteristic of at least one selected signal frequency of the measured pressure oscillations in relation to the crankshaft phase angle signal, and the current compression ratio is determined on the basis of the determined actual value and using reference values of the corresponding characteristic of the respective same signal frequency for different compression ratios.

19 Claims, 5 Drawing Sheets

(52) U.S. Cl.
CPC .. *F02D 2041/288* (2013.01); *F02D 2200/024* (2013.01); *F02D 2200/0414* (2013.01); *F02D 2200/101* (2013.01)

(58) Field of Classification Search
CPC ..... F02D 2200/0414; F02D 2200/101; F02D 15/02; F02D 15/04; F02D 2200/0406; F02D 2700/035; F02D 41/2422; F02D 2041/001; F02D 2041/1433; F02D 41/1448; F02D 41/1401
See application file for complete search history.

(56) References Cited

U.S. PATENT DOCUMENTS

| | | | | |
|---|---|---|---|---|
| 5,786,531 | A * | 7/1998 | Lewis | G01M 15/08 73/114.16 |
| 9,347,384 | B2 * | 5/2016 | Takada | F02D 13/0234 |
| 9,512,788 | B2 | 12/2016 | Tanaka | |
| 10,094,306 | B2 * | 10/2018 | Shaver | F02D 41/3035 |
| 10,344,700 | B2 * | 7/2019 | Yamasaki | F02D 19/084 |
| 10,450,977 | B2 * | 10/2019 | Kainz | F02D 13/0207 |
| 10,570,831 | B2 * | 2/2020 | Braun | F02D 19/088 |
| 10,584,650 | B2 * | 3/2020 | Braun | F02D 19/084 |
| 10,669,965 | B2 * | 6/2020 | Braun | F02D 41/34 |
| 10,711,717 | B2 * | 7/2020 | Braun | F01L 1/34 |
| 10,718,283 | B2 * | 7/2020 | Braun | F01L 1/344 |
| 2007/0250249 | A1 | 10/2007 | Okubo et al. | |
| 2020/0063674 | A1 * | 2/2020 | Braun | F02D 13/00 |
| 2020/0200113 | A1 * | 6/2020 | Braun | F01N 11/00 |
| 2020/0300185 | A1 * | 9/2020 | Braun | F02D 41/0002 |

FOREIGN PATENT DOCUMENTS

| | | | |
|---|---|---|---|
| DE | 102008044329 | A1 | 6/2010 |
| DE | 102013222711 | A1 | 5/2015 |
| DE | 1025209665 | | 12/2015 |
| DE | 102015226138 | B3 | 12/2016 |
| DE | 102015222408 | B3 | 3/2017 |
| JP | 2007291924 | A | 11/2007 |
| JP | 2010265885 | A | 11/2010 |
| JP | 2014137007 | A | 7/2014 |
| KR | 20150036554 | A | 4/2015 |
| WO | 2015197440 | A1 | 12/2015 |

OTHER PUBLICATIONS

German Office Action dated Aug. 1, 2017 for corresponding German Patent Application No. 10 2017 209 112.6.
Japanese Office Action dated Dec. 11, 2020.
Notice of Allowance dated Feb. 4, 2021 for corresponding Korean Patent Application No. 10-2019-7038938.

* cited by examiner

METHOD FOR DETERMINING THE CURRENT COMPRESSION RATIO OF AN INTERNAL COMBUSTION ENGINE DURING OPERATION

CROSS REFERENCE TO RELATED APPLICATIONS

This application claims the benefit of PCT Application PCT/EP2018/063565, filed Mar. 23, 2018, which claims priority to German Application DE 10 2017 209 112.6, filed May 31, 2017. The disclosures of the above applications are incorporated herein by reference.

FIELD OF INVENTION

The present invention relates to a method for determining the current compression ratio of an internal combustion engine from a pressure oscillation signal measured in the inlet tract or in the exhaust gas tract during the operation of the internal combustion engine.

BACKGROUND

Reciprocating-piston internal combustion engines, which will in this context and hereinafter also be referred to in shortened form merely as internal combustion engines, have one or more cylinders each containing a reciprocating piston. To illustrate the principle of a reciprocating-piston internal combustion engine, reference will be made below to FIG. 1, which illustrates by way of example a cylinder of an internal combustion engine, which is possibly also a multi-cylinder internal combustion engine, together with the most important functional units.

The respective reciprocating piston 6 is arranged in linearly movable fashion in the respective cylinder 2 and, together with the cylinder 2, encloses a combustion chamber 3. The respective reciprocating piston 6 is connected by means of a so-called connecting rod 7 to a respective crankpin 8 of a crankshaft 9, wherein the crankpin 8 is arranged eccentrically with respect to the crankshaft axis of rotation 9*a*. As a result of the combustion of a fuel-air mixture in the combustion chamber 3, the reciprocating piston 6 is driven linearly "downward". The translational stroke movement of the reciprocating piston 6 is transmitted by means of the connecting rod 7 and crankpin 8 to the crankshaft 9 and is converted into a rotational movement of the crankshaft 9, which causes the reciprocating piston 6, owing to its inertia, after it passes through a bottom dead center in the cylinder 2, to be moved "upward" again in the opposite direction as far as a top dead center. To permit continuous operation of the internal combustion engine 1, during a so-called working cycle of a cylinder 2, it is necessary firstly for the combustion chamber 3 to be filled with the fuel-air mixture via the so-called inlet tract, for the fuel-air mixture to be compressed in the combustion chamber 3 and to then be ignited (by means of an ignition plug in the case of a gasoline internal combustion engine and by auto-ignition in the case of a diesel internal combustion engine) and burned in order to drive the reciprocating piston 6, and finally for the exhaust gas that remains after combustion to be discharged from the combustion chamber 3 into the exhaust gas tract. Continuous repetition of this sequence results in continuous operation of the internal combustion engine 1, with work being output in a manner proportional to the combustion energy.

Depending on the engine concept, a working cycle of the cylinder 2 is divided into two strokes distributed over one crankshaft rotation)(360° (two-stroke engine) or into four strokes distributed over two crankshaft rotations)(720° (four-stroke engine).

To date, the four-stroke engine has become established as a drive for motor vehicles. In an intake stroke, with a downward movement of the reciprocating piston 6, fuel-air mixture 21 (in the case of intake pipe injection by means of injection valve 5*a*, illustrated as an alternative in FIG. 1 by means of dashed lines) or else only fresh air (in the case of fuel direct injection by means of injection valve 5) is introduced from the inlet tract 20 into the combustion chamber 3. During the following compression stroke, with an upward movement of the reciprocating piston 6, the fuel-air mixture or the fresh air is compressed in the combustion chamber 3, and if appropriate fuel is separately injected by means of an injection valve 5. During the following working stroke, the fuel-air mixture is ignited by means of an ignition plug 4 for example in the case of the gasoline internal combustion engine, and it burns and expands, outputting work, with a downward movement of the reciprocating piston 6. Finally, in an exhaust stroke, with another upward movement of the reciprocating piston 6, the remaining exhaust gas 31 is discharged out of the combustion chamber 3 into the exhaust gas tract 30.

The delimitation of the combustion chamber 3 with respect to the inlet tract 20 or exhaust gas tract 30 of the internal combustion engine 1 is realized generally, and in particular in the example taken as a basis here, by means of inlet valves 22 and outlet valves 32. In the current prior art, said valves are actuated by means of at least one camshaft. The example shown has an inlet camshaft 23 for actuating the inlet valves 22 and has an outlet camshaft 33 for actuating the outlet valves 32. There are normally yet further mechanical components (not illustrated here) for force transmission provided between the valves and the respective camshaft, which components may also include a valve play compensation means (e.g. bucket tappet, rocker lever, finger-type rocker, tappet rod, hydraulic tappet etc.).

The inlet camshaft 23 and the outlet camshaft 33 are driven by means of the internal combustion engine 1 itself. For this purpose, the inlet camshaft 23 and the outlet camshaft 33 are coupled to the crankshaft 9, in each case by means of suitable inlet camshaft control adapters 24 and outlet camshaft control adapters 34, such as for example toothed gears, sprockets or belt pulleys, and with the aid of a control mechanism 40 which has for example a toothed gear mechanism, a control chain or a toothed control belt, in a predefined position with respect to one another and with respect to the crankshaft 9 by means of a corresponding crankshaft control adapter 10, which is accordingly formed as a toothed gear, sprocket or belt pulley. By means of this connection, the rotational position of the inlet camshaft 23 and of the outlet camshaft 33 in relation to the rotational position of the crankshaft 9 is, in principle, defined. By way of example, FIG. 1 illustrates the coupling between inlet camshaft 23 and the outlet camshaft 33 and the crankshaft 9 by means of belt pulleys and a toothed control belt.

The rotational angle covered by the crankshaft during one working cycle will hereinafter be referred to as the working phase or simply as the phase. A rotational angle covered by the crankshaft within one working phase is accordingly referred to as the phase angle. The respectively current crankshaft phase angle of the crankshaft 9 can be detected continuously by means of a position encoder 43 connected to the crankshaft 9 or to the crankshaft control adapter 10, and an associated crankshaft position sensor 41. Here, the position encoder 43 may be formed for example as a toothed gear with a multiplicity of teeth arranged so as to be distributed equidistantly over the circumference, wherein the number of individual teeth determines the resolution of the crankshaft phase angle signal.

It is likewise additionally possible, if appropriate, for the present phase angles of the inlet camshaft 23 and of the outlet camshaft 33 to be detected continuously by means of corresponding position encoders 43 and associated camshaft position sensors 42.

Since, owing to the predefined mechanical coupling, the respective crankpin 8, and with the latter the reciprocating piston 6, the inlet camshaft 23, and with the latter the respective inlet valve 22, and the outlet camshaft 33, and with the latter the respective outlet valve 32, move in a predefined relationship with respect to one another and in a manner dependent on the crankshaft rotation, said functional components run through the respective working phase synchronously with respect to the crankshaft. The respective rotational positions and stroke positions of reciprocating piston 6, inlet valves 22 and outlet valves 32 can thus, taking into consideration the respective transmission ratios, be set in relation to the crankshaft phase angle of the crankshaft 9 predefined by the crankshaft position sensor 41. In an ideal internal combustion engine, it is thus possible for every particular crankshaft phase angle to be assigned a particular crankpin angle, a particular piston stroke, a particular inlet camshaft angle and thus a particular inlet valve stroke, and also a particular outlet camshaft angle and thus a particular outlet camshaft stroke. That is to say, all of the stated components are, or move, in phase with the rotating crankshaft 9.

Also symbolically illustrated is an electronic, programmable engine control unit 50 (CPU) for controlling the engine functions, which engine control unit 50 is equipped with signal inputs 51 for receiving the various sensor signals and with signal and power outputs 52 for actuating corresponding positioning units and actuators, and with an electronic processing unit 53 and an assigned electronic memory unit 54.

Owing to the so-called exhaust and refill process of the internal combustion engine, i.e. the induction of fresh air 21 or fuel-air mixture from the intake tract 20, also referred to as the inlet tract, into the combustion chamber 3, and the expulsion of the exhaust gas 31 into the outlet tract 30, also referred to as the exhaust gas tract, which takes place after combustion and depends on the stroke motion of the reciprocating piston 6 and the opening and closing of the inlet valves 22 and outlet valves 32, pressure oscillations are generated in the intake air or the air-fuel mixture in the intake tract and in the exhaust gas in the outlet tract, and these likewise occur in phase with the rotation of the crankshaft 9 and can thus be set in relation to the crankshaft phase angle.

In order to optimize the operation of an internal combustion engine, it has long been the practice in the prior art to detect continuously determined actual operating parameters by means of sensors and, in the event of deviations from setpoint operation, to adapt or correct the influencing control parameters by means of the electronic engine control unit. The focus here has hitherto been on fuel injection quantities, injection and ignition points, valve timings, boost pressure, air mass supplied, exhaust gas composition (lambda values), exhaust gas temperature etc.

Worldwide, ever more stringent legal requirements imposed on exhaust gas composition and quantities from internal combustion engines have more recently led developers to focus on the so-called compression ratio ε, as explained with reference to FIG. 2. In conventional internal combustion engines, the compression ratio is a value set by the design and mechanical structure of the internal combustion engine, and describes the ratio of the combustion space VR to the compression space KR. The compression space KR describes the residual volume enclosed in the cylinder by the piston when the piston is at top dead center TDC, as illustrated in FIG. 2*a*). The combustion space is the entire volume enclosed in the cylinder by the piston when the piston is at bottom dead center BDC, as shown in FIG. 2*b*), and is composed of the compression space and the piston space HR, wherein the piston space HR corresponds to the volume displaced by the piston in the cylinder on its piston travel H from bottom dead center to top dead center, and thus results from the piston or cylinder cross-sectional area Q multiplied by the piston travel H.

This gives the compression ratio ε as:

$$\varepsilon = VR/KR = (HR+KR)/KR$$

By increasing the compression ratio, the efficiency of the internal combustion engine may be increased. However, because of the pressures and temperatures which rise with the compression ratio, limits are imposed by the mechanical strength of the cylinders, the cylinder head gaskets and not least by the fuel quality, in particular the knock resistance. During the development of internal combustion engines, various measures could be taken to increase the compression ratio from the initial 4:1 up to 15:1 for petrol engines and up to 23:1 for diesel engines.

It has however been found that the same high compression ratio is not optimal at every operating point of an internal combustion engine. This has led to the desire for a variable compression ratio, in order to be able to set the optimal compression ratio for every operating point. Solutions already exist here, in which for example the piston travel may be varied via a so-called multi-link system, or the compression space may be increased or reduced by tilting the cylinder head. The piston travel or the tilt angle may be adjusted during operation via corresponding actuators.

Here too, as already described in connection with the abovementioned operating parameters of the internal combustion engine, it is essential that the real actual value of the set compression ratio is compared with the specified setpoint and that a corrective intervention can be made. For this, the current compression ratio must be determined reliably. Previously, this could only be achieved indirectly via determination of the adjustment travel of the actuator, or in some cases directly via cylinder pressure sensors. In the first case, uncertainties remain since any existing tolerances or deviations in the adjustment system are not determined, and in the second case substantially higher costs are incurred together with additional equipment complexity for the additional sensors. Even in the case of internal combustion engines with constant compression ratio, however, determination of the current compression ratio during continuous operation is desirable, e.g. for early detection of wear phenomena or for so-called on-board diagnosis (OBD), as well as for checking the plausibility of further operating parameters or for detecting external mechanical interventions into the mechanism of the internal combustion engine, e.g. in the course of tuning measures.

SUMMARY

It is therefore to permit, in an aspect as far as possible without additional sensor arrangement and outlay in terms of apparatus, as exact as possible a determination of the current compression ratio during presently ongoing operation for each individual cylinder, in order to be able to make corresponding adaptations to the operating parameters in order to optimize the ongoing operation.

This aspect is achieved by an embodiment of the invention for determining the current compression ratio of an internal combustion engine during operation. Developments and design variants of the method according to the invention are discussed below.

The achievement of the aspect, as indicated below, is based on the insight that there is a unique relationship between the compression ratio and the pressure oscillations in the intake tract and outlet tract.

According to one embodiment of the method, the dynamic pressure oscillations, assignable to one cylinder of the internal combustion engine, in the intake tract or in the outlet tract of the respective internal combustion engine are measured at a defined operating point during normal operation, and from these a corresponding pressure oscillation signal is generated. At the same time, that is in temporal association, a crankshaft phase angle signal of the internal combustion engine is determined as a type of reference signal for the pressure oscillation signal.

One possible operating point would for example be idle operation at a predefined rotational speed. Care should advantageously be taken here to ensure that other influences on the pressure oscillation signal are as far as possible excluded or at least minimized. Normal operation characterizes the intended operation of the internal combustion engine, for example in a motor vehicle, wherein the internal combustion engine is an example of a series of internal combustion engines of identical design. Further customary terms for an internal combustion engine of said type would be series internal combustion engine or field internal combustion engine.

The measured pressure oscillations in the intake tract or in the outlet tract are pressure oscillations in the intake air or the induced air-fuel mixture in the intake tract, or are pressure oscillations in the exhaust gas in the outlet tract.

From the pressure oscillation signal, using discrete Fourier transformation, at least one actual value of at least one characteristic of at least one selected signal frequency of the measured pressure oscillations in relation to the crankshaft phase angle signal is then determined.

In the further course of the method, the current compression ratio of the internal combustion engine is then determined on the basis of the at least one determined actual value for the respective characteristic, taking into consideration reference values of the respectively corresponding characteristic of the respectively identical signal frequency for different compression ratios.

For the analysis of the pressure oscillation signal recorded in the intake tract or in the outlet tract of the internal combustion engine, said pressure oscillation signal is subjected to a discrete Fourier transformation (DFT). For this purpose, an algorithm known as a fast Fourier transformation (FFT) may be used for the efficient calculation of the DFT. By means of DFT, the pressure oscillation signal is now broken down into individual signal frequencies which can thereafter be separately analysed in simplified fashion with regard to their amplitude and the phase position. In the present case, it has been found that both the phase position and the amplitude of selected signal frequencies of the pressure oscillation signal are dependent on the compression ratio of the respective cylinder. Advantageously, for this only those signal frequencies are used which correspond to the intake frequency, the base frequency or the first harmonic of the internal combustion engine or to a multiple of the intake frequency, that is to say the 2nd to n-th harmonic, wherein the intake frequency in turn has a unique relationship with the speed and thus with the combustion cycle or phase cycle of the internal combustion engine. Then, for at least one selected signal frequency, taking into consideration the crankshaft phase angle signal detected in parallel, at least one actual value of the phase position, the amplitude, or for both as a characteristic of said selected signal frequencies, is determined in relation to the crankshaft phase angle.

In order now to determine the compression ratio from the determined actual value of the characteristic of the selected signal frequency of the pressure oscillation signal, the value of the determined characteristic is compared with so-called reference values of the respectively corresponding characteristic of the respectively identical signal frequency for different compression ratios of the internal combustion engine. The corresponding compression ratios are uniquely assigned to these reference values of the respective characteristic. This enables the associated compression ratio to be inferred by way of the reference value coinciding with the determined actual value.

The advantages of the method according to the invention reside in the fact that the current compression ratio of each individual cylinder of the internal combustion engine can be determined purely on the basis of a respective pressure signal, which can be determined by means of sensors that are present in the system in any case, and can be analysed or processed by means of an electronic processing unit which is present in any case for engine control, without additional outlay in terms of apparatus. When required, it is then possible on this basis to correctively modify the control parameters of the internal combustion engine such that optimal operation at the respective operating point is ensured.

BRIEF DESCRIPTION OF THE DRAWINGS

To explain the functioning of an internal combustion engine underlying the embodiments and the relationships between the compression ratio and the characteristics, phase position and amplitude of the pressure oscillation signal measured in the intake tract or outlet tract for certain selected signal frequencies, and to describe particularly advantageous exemplary embodiments, details or developments of the subject matter of the embodiments, reference is made below to the figures, although there is no intention to restrict the subject matter of the invention to these examples. The drawings show.

DETAILED DESCRIPTION

Items of identical function and designation are denoted by the same reference signs throughout the figures.

Figure 1:
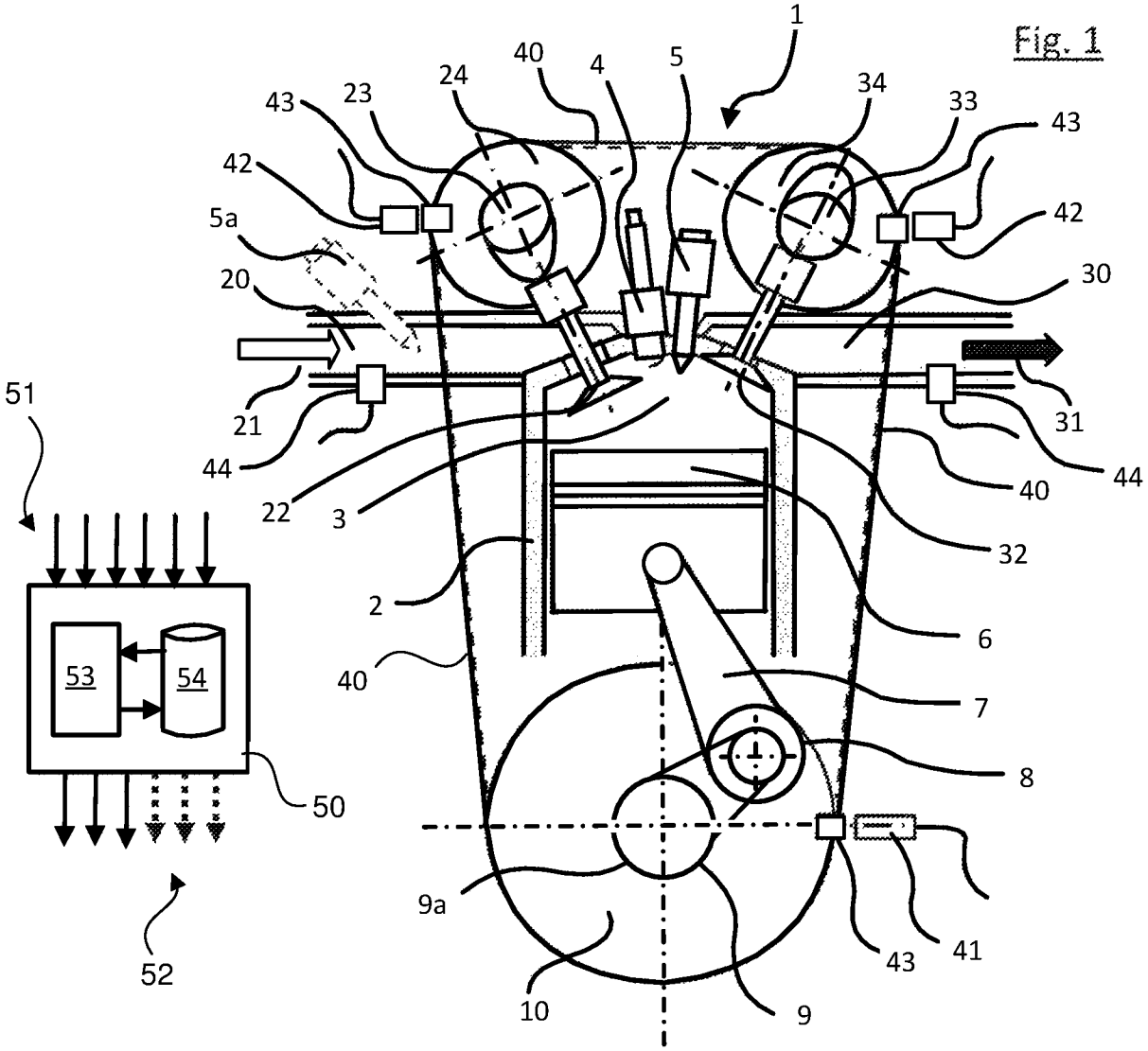
FIG. 1 a simplified illustration of a reciprocating-piston internal combustion engine, referred to here in shortened form as an internal combustion engine, with pertinent functional components.
Figure 2:
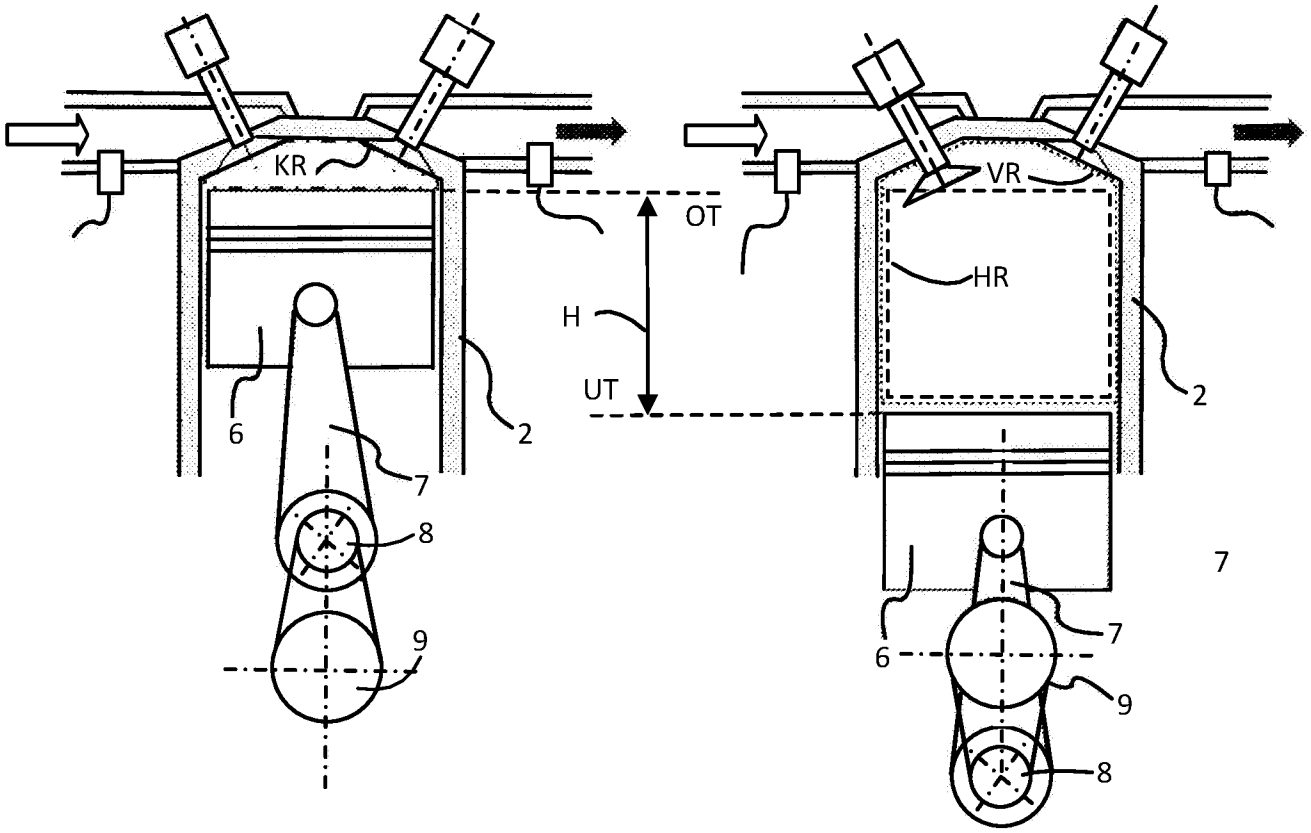
FIG. 2 two further simplified depictions a) and b) of the internal combustion engine to explain the compression ratio, wherein a) shows the piston at top dead center and b) shows the piston at bottom dead center.

FIGS. 1 and 2 have already been thoroughly explored in the above description of the principle of operation of an internal combustion engine and for the explanation of the compression ratio.

In the implementation of the method, it is assumed, as already mentioned above, that the relationship or the dependency of the stated variables between or on one another is uniquely known. The relationships are explained below for the pressure oscillation signal measured in the intake tract, but are similarly applicable to the pressure oscillation signal in the outlet tract too.

Figure 3:
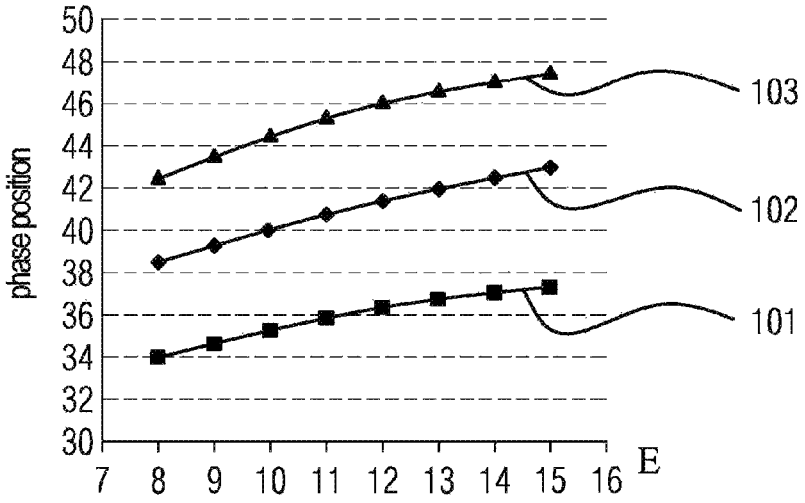
FIG. 3 a diagram intended to illustrate the dependency between the phase position of the pressure oscillation signal and the compression ratio at various signal frequencies.

FIG. 3 shows the correlation as an example using the characteristic of the phase position of the pressure oscillation signal in the inlet tract as a function of the compression ratio ε at various signal frequencies. For each signal frequency, a shift in the value of the phase position is evident towards greater values as the compression ratio ε rises. Interpolation between the individual measurement points gives a constantly rising, almost linear gradient for curve 101 for the intake frequency, curve 102 for double intake frequency, and curve 103 for triple intake frequency, or the so-called first, second and third harmonics. Here, the values of the second harmonic are throughout higher than those of the first harmonic by a value rising slightly with the increasing compression ratio ε, and the values of the third harmonic are throughout higher than those of the second harmonic by a value rising slightly with the increasing compression ratio ε, so that the three curves shown diverge slightly with the rising compression ratio ε.

Figure 4:
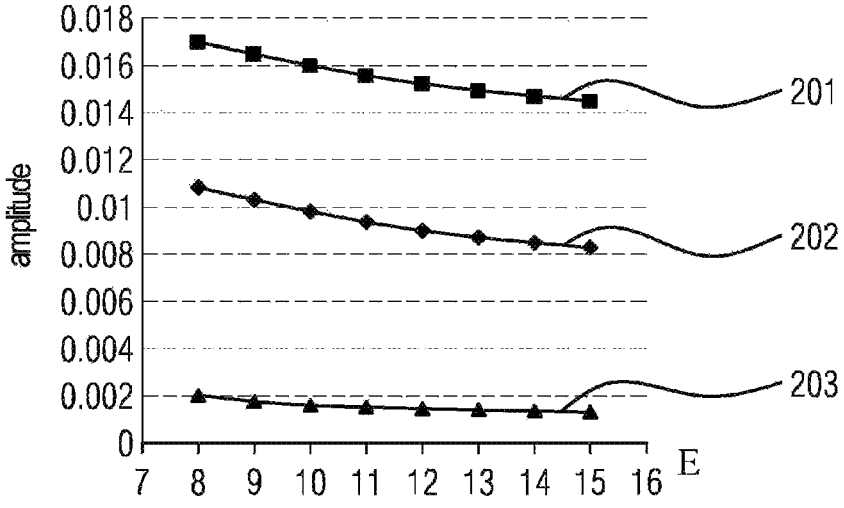
FIG. 4 a diagram intended to illustrate the dependency between the amplitude of the pressure oscillation signal and the compression ratio at various signal frequencies.

FIG. 4 shows a similar correlation using the characteristic of the amplitude of the pressure oscillation signal in the inlet tract as a function of the compression ratio ε, again at various signal frequencies. For each signal frequency, a shift in the value of the amplitude is evident towards smaller values as the compression ratio ε rises. Interpolation between the individual measurement points gives a constantly falling, almost linear gradient for curve 201 for the intake frequency, curve 202 for double intake frequency, and curve 103 for triple intake frequency, or the so-called first, second and third harmonics. Here, the values of the second harmonic are throughout lower than those of the first harmonic by a value falling slightly with the increasing compression ratio ε, and the values of the third harmonic are throughout lower than those of the second harmonic by a value falling slightly with the increasing compression ratio ε, so that the three curves shown converge slightly with the rising compression ratio ε.

Figure 5:
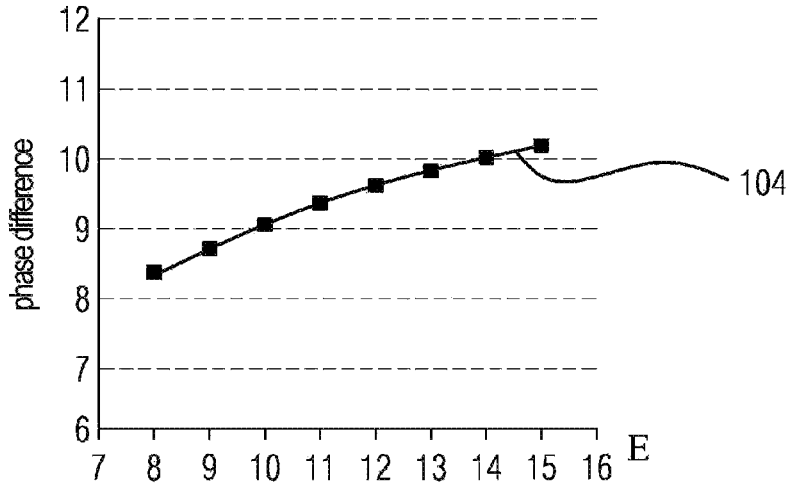
FIG. 5 a diagram to illustrate the dependency between the phase position difference of the phase positions of two different signal frequencies of the pressure oscillation signal, and the compression ratio.

FIG. 5 shows as a further characteristic of the pressure oscillation signal, the phase difference or phase position difference between the respective values of the phase position of the third harmonic and the first harmonic as a function of the compression ratio ε. As the depiction in FIG. 4 shows, this gives a curve 104 which rises with the increasing compression ratio ε, i.e. a similar correlation to that of the individual phase positions. The advantage of this characteristic is that due to the difference formation, any disturbance variables, contained to the same proportions in the individual curves, can be eliminated. Evidently, other harmonics may also be used for difference formation.

In one embodiment of the method according to the invention, the reference values of the respective characteristic as a function of the compression ratio are made available in at least one respective reference value map. Such a reference value map may for example contain reference values for the phase position as a function of the compression ratio for different signal frequencies, as depicted in FIG. 3, or reference values for the amplitude as a function of the compression ratio for different signal frequencies, as depicted in FIG. 4, or reference values for difference values between two phase positions or amplitudes, determined for different signal frequencies, as a function of the compression ratio, as shown in FIG. 5. Here, a plurality of such maps can be made available for respective different operating points of the internal combustion engine. Thus, a corresponding, more comprehensive map may, for example, include corresponding reference value curves for different operating points of the internal combustion engine and different signal frequencies.

Figure 6:
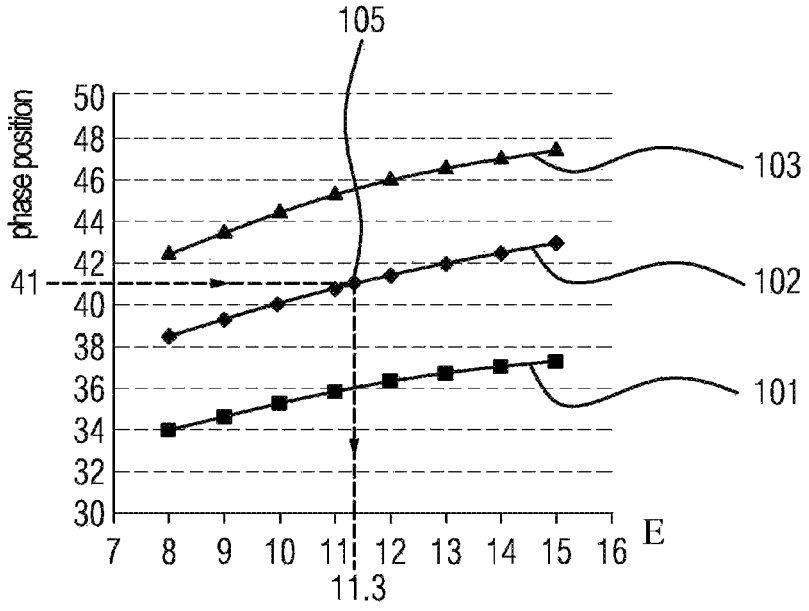
FIG. 6 a diagram intended to illustrate reference phase positions of different signal frequencies as a function of the compression ratio, and the determination of a specific value of the compression ratio based on a currently determined value of the phase position of a pressure oscillation signal.

The current compression ratio of a respective cylinder of the internal combustion engine can then be determined in a simple manner, as illustrated in FIG. 6 by the example of the phase position, as follows: starting from the determined actual value of a characteristic of the pressure oscillation signal (here the value of 41 of the phase position), for a selected signal frequency (here the second harmonic 102), in normal operation of the internal combustion engine, the associated point 105 on the reference curve of the second harmonic 102 is determined, and from this, in turn, the associated compression ratio is determined, in this case ε=11.3, as indicated visually by the dashed line in FIG. 6. Thus, the current compression ratio can be determined during operation in a particularly simple manner and with little computational effort.

As an option, instead or additionally, at least one respective algebraic model function characterizing the corresponding reference curve is provided for the mathematical determination of the respective reference value of the respectively corresponding characteristic, and represents the relationship between the characteristic and the compression ratio. The determined actual value of the respective characteristic is specified, and the compression ratio is then calculated in real time. The advantage of this alternative lies in the fact that, overall, less memory capacity need be made available.

Advantageously, the execution of the method, i.e. the determination of the actual value of the respective characteristic of the selected signal frequency and the determination of the current compression ratio of the internal combustion engine, is performed with the aid of an electronic processing unit assigned to the internal combustion engine and preferably part of an engine control unit. Here, the respective reference value map and/or the respective algebraic model function are/is stored in at least one electronic memory area assigned to the electronic processing unit, and also preferably part of the engine control unit. This is illustrated in simplified form with the aid of the block diagram in FIG. 7. An engine control unit 50 containing the electronic processing unit 53 is illustrated symbolically here by the frame in dashed lines, which contains the individual steps/blocks of the method according to the invention and the electronic memory area 54.

One particularly advantageous possibility for carrying out the method involves the use of an electronic processing unit 53 assigned to the internal combustion engine and for example part of the central engine control unit 50, also referred to as a central processing unit or CPU, which is used to control the internal combustion engine 1. In this case, the reference value maps or the algebraic model functions can be stored in at least one electronic memory area 54 of the CPU 50.

In this way, the method according to the invention can be carried out automatically, very quickly and repeatedly during the operation of the internal combustion engine, and further control variables or control routines for controlling the internal combustion engine as a function of the determined compression ratio can be adapted directly by the engine control unit.

This firstly has the advantage that no separate electronic processing unit is required, and there are thus also no additional interfaces, which may be susceptible to failure, between multiple processing units. Secondly, the method according to the invention can thus be made an integral constituent part of the control routines of the internal combustion engine, whereby the control variables or control routines for the internal combustion engine can rapidly be adapted to the current compression ratio.

As already indicated above, it is assumed that the reference values of the respective characteristic for different compression ratios are available for the implementation of the method.

For this purpose, in an enhancement of the method according to the invention, the reference values of the respective characteristic for at least one selected signal frequency are determined in advance on a reference internal combustion engine as a function of different compression ratios. This is illustrated symbolically in the block diagram in FIG. 7 by the blocks denoted by B10 and B11, wherein block B10 indicates the measurement of a reference internal combustion engine (Vmssg_Refmot) and block B11 symbolizes the collation of the measured reference values of the respective characteristic at selected signal frequencies to form reference value maps (RWK_DSC_SF1 . . . X). Here, the reference internal combustion engine is an internal combustion engine of identical design to the corresponding internal combustion engine series, and in which, in particular, it is ensured that no behavior-influencing structural tolerance deviations are present. This is intended to ensure that the relationship between the respective characteristic of the pressure oscillation signal and the compression ratio can be determined as accurately as possible and without the influence of further disturbance factors.

Corresponding reference values can be determined by means of the reference internal combustion engine at different operating points and with presetting or variation of further operating parameters, such as the temperature of the intake medium, the coolant temperature or the engine speed. The reference value maps thus generated, see FIGS. 3, 4 and 5 for example, can then advantageously be made available in all internal combustion engines of identical design in the series, in particular stored in an electronic memory area 54 of an electronic engine control unit 50 assignable to the internal combustion engine.

As a continuation of the abovementioned prior determination of the reference values of the respective characteristic of the selected signal frequencies, it is possible, from the determined reference values of the selected signal frequency and the associated compression ratio, to derive a respective algebraic model function which represents at least the relationship between the respective characteristic of the selected signal frequency and the compression ratio. This is symbolized in the block diagram in FIG. 7 by the block denoted by B12. Here, it is optionally also possible for the abovementioned further parameters to also be incorporated. An algebraic model function (Rf(DSC_SF_1 . . . X) is thus generated with which, with presetting of the phase position and possible incorporation of the abovementioned variables, the respective current compression ratio can be calculated.

The model function can then advantageously be made available in all internal combustion engines of identical design in the series, in particular stored in an electronic memory area 54 of an electronic engine control unit 50 assignable to the internal combustion engine. The advantages lie in the fact that the model function requires less memory space than comprehensive reference value maps.

In an implementation example, the prior determination of the reference values of the respective characteristic of the selected signal frequency can be performed by the measurement of a reference internal combustion engine (Vmssg_Refmot), at least at one defined operating point, while specifying certain reference compression ratios. This is symbolized in the block diagram in FIG. 7 by the block denoted by B10. Here, for the determination of the reference values of the respective characteristic of the selected signal frequency, the dynamic pressure oscillations assignable to one cylinder of the reference internal combustion engine in the intake tract or in the outlet tract are measured during operation, and a corresponding pressure oscillation signal is generated.

At the same time, i.e. in temporal association with the measurement of the dynamic pressure oscillations, a crankshaft phase angle signal is determined. Subsequently, reference values of the respective characteristic of the selected signal frequency of the measured pressure oscillations in relation to the crankshaft phase angle signal are determined from the pressure oscillation signal by means of discrete Fourier transformation.

The determined reference values are then stored as a function of the associated compression ratio in reference value maps (RWK_DSC_SF_1 . . . X). This allows reliable determination of the dependency between the respective characteristic of the pressure oscillation signal of the selected signal frequency and the compression ratio.

In all the abovementioned embodiments and developments of the method, a phase position or an amplitude or, alternatively, a phase position and an amplitude of at least one selected signal frequency can be used as the at least one characteristic of the measured pressure oscillations. The phase position and the amplitude are the essential basic characteristics which can be determined by means of discrete Fourier transformation in relation to individual selected signal frequencies. In the simplest case, at a specific operating point of the internal combustion engine, precisely one actual value is determined, for example the phase position at a selected signal frequency, for example the second harmonic, and by allocating this value to the corresponding reference value of the phase position in the stored reference value map, at the same signal frequency, the assigned value for the compression ratio is determined.

However, it is also possible for a plurality of actual values e.g. for the phase position and the amplitude, and at different signal frequencies, to be determined and combined in order to determine the compression ratio, e.g. by averaging. In this way, it is advantageously possible to increase the accuracy of the determined value for the compression ratio.

As an alternative to isolated consideration of the phase position or amplitude of a respective signal frequency, a combination of several actual values of the phase position or several actual values of the amplitude at different signal frequencies may be considered. Thus a differential value between two values, determined for different signal frequencies, of the phase position of the pressure oscillation signal, or a differential value between two values, determined for different signal frequencies, of the amplitude of the pressure oscillation signal may be used as the at least one characteristic of the measured pressure oscillations. In this way for example, disturbance variables, which have the same effect on the respective absolute actual values at different signal frequencies, may be eliminated.

It has proven to be advantageous to choose as selected signal frequencies the intake frequency or a multiple of the intake frequency, i.e. the 1st harmonic, the 2nd harmonic, the 3rd harmonic, etc. At these signal frequencies, the dependency of the respective characteristic of the pressure oscillation signal on the compression ratio is particularly clearly evident.

In order, in a refinement of the method, to further increase the accuracy of the determination of the compression ratio, it is possible for additional operating parameters of the internal combustion engine to be taken into consideration in the determination of the compression ratio. For this purpose, at least one of the further operating parameters

- temperature of the intake medium in the intake tract,
- temperature of a coolant used for cooling the internal combustion engine, and
- engine speed of the internal combustion engine may be taken into consideration in the determination of the compression ratio.

The temperature of the intake medium, that is to say substantially of the intake air, directly influences the speed of sound in the medium and thus the pressure propagation in the inlet tract. This temperature can be measured in the intake tract and is therefore known. The temperature of the coolant can also influence the speed of sound in the intake medium owing to heat transfer in the intake tract and in the cylinder. This temperature is generally also monitored and, for this purpose, measured, and is thus available in any case and can be taken into consideration in the determination of the compression ratio.

The engine speed is one of the variables that characterizes the operating point of the internal combustion engine, and influences the time available for the pressure propagation in the intake tract. The engine speed is also constantly monitored and is thus available for the determination of the fuel composition.

The abovementioned additional parameters are thus available in any case, or can be determined in a straightforward manner. The respective influence of the stated parameters on the respective characteristic of the selected signal frequency of the pressure oscillation signal is in this case assumed to be known, and, as already noted above, has been determined for example during the measurement of a reference internal combustion engine and also stored in the reference value maps. The incorporation by means of corresponding correction factors or correction functions in the calculation of the fuel composition by means of an algebraic model function also constitutes a possibility for taking these additional, further operating parameters into consideration in the determination of the compression ratio.

For the implementation of the method according to the invention, it is furthermore advantageously possible for the dynamic pressure oscillations in the intake tract to be measured by means of a standard pressure sensor, e.g. in the intake manifold. This has the advantage that no additional pressure sensor is required, which represents a cost advantage.

In a further embodiment, for the implementation of the method, the crankshaft position feedback signal may be determined by means of a toothed gear and a Hall sensor, wherein this is a customary sensor arrangement which may be present in the internal combustion engine in any case for detecting the crankshaft rotation. The toothed gear is in this case arranged for example on the outer circumference of a flywheel or of the crankshaft timing adapter 10 (see also FIG. 1). This has the advantage that no additional sensor arrangement is required, which represents a cost advantage.

Figure 7:
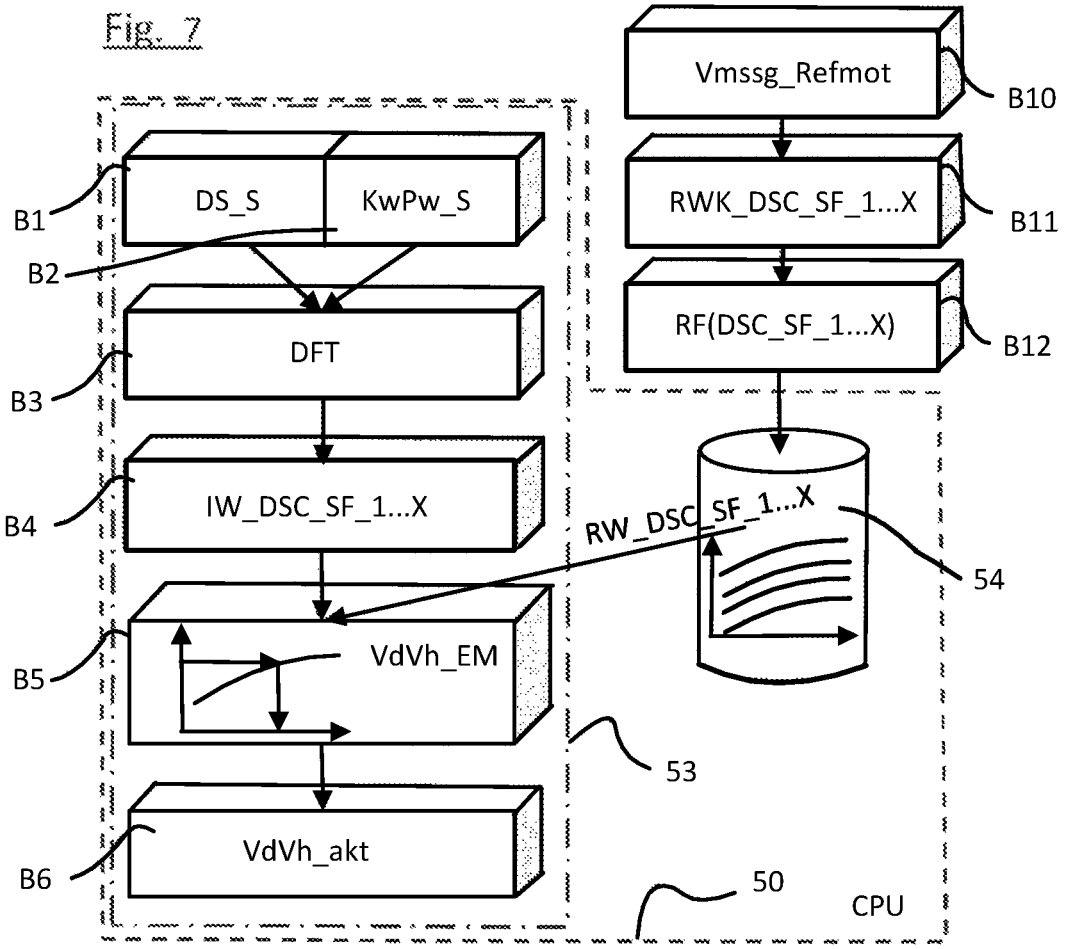
FIG. 7 a block diagram for schematic illustration of one embodiment of the invention.

FIG. 7 illustrates an embodiment of the method according to the invention for determining the current compression ratio of an internal combustion engine during operation, once again in the form of a simplified block diagram showing the significant steps.

The border shown by dashed lines around the corresponding blocks B1 to B6 and 54 in the block diagram symbolically represents the boundary between an electronic, programmable engine control unit 50, e.g. of an engine control unit referred to as a CPU, of the respective internal combustion engine on which the method is executed. This electronic engine control unit 50 contains, inter alia, the electronic processing unit 53 for executing the method according to the invention, and the electronic memory area 54.

At the start, dynamic pressure oscillations, assignable to the respective cylinder, of the intake air in the intake tract and/or of the exhaust gas in the outlet tract of the respective internal combustion engine are measured during operation, and a corresponding pressure oscillation signal (DS_S) is generated from these, and a crankshaft phase angle signal (KwPw_S) is determined at the same time, i.e. in temporal dependency, as illustrated by the blocks arranged in parallel, which are denoted by B1 and B2.

Then, from the pressure oscillation signal (DS_S), an actual value (IW_DSC_SF_1 . . . X) of at least one characteristic of at least one selected signal frequency of the measured pressure oscillations in relation to the crankshaft phase angle signal (KwPw_S) is determined using discrete Fourier transformation DFT, this being illustrated by the block denoted by B4.

On the basis of the at least one determined actual value (IW_DSC_SF_1 . . . X) of the respective characteristic, a compression ratio determination (VdVhEM) is then carried out in block B5. This is accomplished taking into consideration reference values (RW_DSC_SF_1 . . . X) of the respectively corresponding characteristic of the respectively identical signal frequency for different compression ratios, which are made available in the memory area denoted by 54 or are determined in real time with the aid of the algebraic model functions stored in the memory area 54. The resulting current value of the compression ratio (VdVh_akt) of the internal combustion engine is then made available in block B6.

FIG. 7 furthermore shows, in blocks B10, B11 and B12, the steps which precede the method described above. In block B10, a reference internal combustion engine (Vmss-g_Refmot) is measured, in order to determine reference values of the respective characteristic of the respectively selected signal frequency of the measured pressure oscillations in relation to the crankshaft phase angle signal from the pressure oscillation signal by means of discrete Fourier transformation. In block B11, the determined reference values are then collated in reference value maps (RWK_DSC_SF_1 . . . X) as a function of the associated values of the compression ratio, and are stored in the electronic memory area 54 of the engine control unit 50 denoted by CPU.

The block denoted by B12 contains the derivation from algebraic model functions (Rf(DSC_SF_1 . . . X)), which, as reference value functions, depict for example the profile of the respective reference value curves of the respective characteristic of the pressure oscillation signal for a respective signal frequency as a function of the compression ratio, on the basis of the previously determined reference value maps (RWK_DSC_SF_1 . . . X). It is then likewise possible, as an alternative or in addition, for these algebraic model functions (Rf(DSC_SF_1 . . . X)) to be stored in the electronic memory area 54, denoted by 54, of the engine control unit 50 denoted by CPU, where they are available for implementing the above-explained method according to the invention.

Summarized briefly once again, the essence of the method according to the invention for determining the current compression ratio is a method in which dynamic pressure oscillations in the intake tract or outlet tract of the respective internal combustion engine are measured during normal operation, and from these a corresponding pressure oscillation signal is generated. At the same time, a crankshaft phase angle signal is determined and set in relation to the pressure oscillation signal. The pressure oscillation signal is used to determine an actual value of at least one characteristic of at least one selected signal frequency of the measured pressure oscillations in relation to the crankshaft phase angle signal, and the current compression ratio is determined on the basis of the determined actual value and using reference values of the corresponding characteristic of the respective same signal frequency for different compression ratios.

The invention claimed is:

1. A method for determining the current compression ratio of an internal combustion engine during operation, comprising:

measuring dynamic pressure oscillations, assignable to one cylinder of the internal combustion engine, in an intake tract or in an outlet tract of the internal combustion engine at a defined operating point during normal operation, generating a corresponding pressure oscillation signal from the measured dynamic pressure oscillations, and at the same time, determining a crankshaft phase angle signal of the internal combustion engine, from the pressure oscillation signal and using discrete Fourier transformation, determining at least one actual value of at least one characteristic of at least one selected signal frequency of the measured pressure oscillations in relation to the crankshaft phase angle signal, and determining a current compression ratio of the internal combustion engine on the basis of the at least one determined actual value of the at least one characteristic, based on reference values of the respectively corresponding characteristic of the respectively identical signal frequency for different compression ratios.

2. The method as claimed in claim 1, wherein the reference values of the respective characteristic as a function of the compression ratio are made available in at least one respective reference value map, or at least one respective algebraic model function for a mathematical determination of the respective reference value of the respectively corresponding characteristic is made available, the model representing a relationship between the characteristic and the compression ratio.

3. The method as claimed in claim 2, wherein the determination of the at least one actual value of the respective characteristic of the selected signal frequency and the determination of the current compression ratio of the internal combustion engine are performed by an electronic processing unit assigned to the internal combustion engine, wherein the respective reference value map or the respective algebraic model function is stored in at least one memory area assigned to the electronic processing unit.

4. The method as claimed in claim 2, wherein the reference values of the respective characteristic for at least one selected signal frequency are determined in advance on a reference internal combustion engine as a function of different compression ratios.

5. The method as claimed in claim 4, wherein a model function representing the relationship between the characteristic of the selected signal frequency and the compression ratio is in each case derived from the reference values of the respective characteristic of the selected signal frequency and the assigned compression ratio.

6. The method as claimed in claim 5, wherein the prior determination of the reference values of the respective characteristic of the respectively selected signal frequency is based on a measurement of the reference internal combustion engine, at least at one defined operating point, while specifying certain reference compression ratios, wherein, to determine the reference values of the respective characteristic of the respectively selected signal frequency, the dynamic pressure oscillations, assignable to the one cylinder of the reference internal combustion engine, in the intake tract or in the outlet tract are measured during operation, and a corresponding pressure oscillation signal is generated, wherein, at the same time, a crankshaft phase angle signal is determined, wherein the reference values of the respective characteristic of the respectively selected signal frequency of the measured pressure oscillations in relation to the crankshaft phase angle signal are determined from the pressure oscillation signal by discrete Fourier transformation, and wherein the determined reference values as a function of the associated compression ratios are stored in reference value maps.

7. The method as claimed in claim 1, wherein a phase position or an amplitude, or a phase position and an amplitude of at least one selected signal frequency is used as the at least one characteristic of the measured pressure oscillations.

8. The method as claimed in claim 1, wherein a differential value between two values, determined for different signal frequencies, of a phase position of the pressure oscillation signal, or a differential value between two amplitudes, determined for different signal frequencies, of the pressure oscillation signal is used as the at least one characteristic of the measured pressure oscillations.

9. The method as claimed in claim 1, wherein the selected signal frequencies are an intake frequency or a multiple of the intake frequency.

10. The method as claimed in claim 1, wherein determining the compression ratio of the internal combustion engine is based on at least one of a temperature of an intake medium in the intake tract, a temperature of a coolant used for cooling the internal combustion engine, and an engine speed of the internal combustion engine.

11. The method as claimed in claim 1, wherein the dynamic pressure oscillations in the intake tract of the internal combustion engine are measured by a standard pressure sensor.

12. The method as claimed in claim 1, further comprising determining a crankshaft position feedback signal by a toothed gear and a Hall sensor.

13. The method as claimed claim 3, wherein the electronic processing unit is part of an engine control unit for controlling the internal combustion engine, and an adaptation of further control variables or control routines for the control of the internal combustion engine is performed by the engine control unit as a function of the determined compression ratio.

14. An electronic processing unit for at least partly controlling an internal combustion engine, the electronic processing unit configured to perform a method comprising:

measuring dynamic pressure oscillations, assignable to one cylinder of the internal combustion engine, in an intake tract or in an outlet tract of the internal combustion engine at a defined operating point during normal operation, generating a corresponding pressure oscillation signal from the measured dynamic pressure oscillations, and determining a crankshaft phase angle signal of the internal combustion engine, from the pressure oscillation signal and using discrete Fourier transformation, determining at least one actual value of at least one characteristic of at least one selected signal frequency of the measured pressure oscillations in relation to the crankshaft phase angle signal, and determining a current compression ratio of the internal combustion engine based on the at least one determined actual value of the at least one characteristic and reference values of a corresponding characteristic of an identical signal frequency for different compression ratios.

15. The electronic processing unit of claim 14, wherein the reference values as a function of the compression ratio are made available in at least one respective reference value map, or in at least one respective algebraic model function for a mathematical determination of the respective reference value is made available, the model representing a relationship between the characteristic and the compression ratio.

16. The electronic processing unit of claim 15, wherein the respective reference value map or the respective algebraic model function is stored in at least one memory communicatively coupled to the electronic processing unit.

17. The electronic processing unit of claim 15, wherein the reference values of the at least one characteristic for at least one selected signal frequency are determined in advance on a reference internal combustion engine as a function of different compression ratios.

18. The electronic processing unit of claim 17, wherein a model function representing the relationship between the characteristic of the selected signal frequency and the compression ratio is in each case derived from the reference values of the respective characteristic of the selected signal frequency and the assigned compression ratio.

19. The electronic processing unit of claim 18, wherein prior determination of the reference values of the respective characteristic of the respectively selected signal frequency is based on a measurement of the reference internal combustion engine and at least at one defined operating point, while specifying certain reference compression ratios, wherein, to determine the reference values of the respective characteristic of the respectively selected signal frequency, the dynamic pressure oscillations, assignable to one cylinder of the reference internal combustion engine, in the intake tract or in the outlet tract are measured during operation, and a corresponding pressure oscillation signal is generated, wherein, at the same time, a crankshaft phase angle signal is determined, wherein the reference values of the respective characteristic of the respectively selected signal frequency of the measured pressure oscillations in relation to the crankshaft phase angle signal are determined from the pressure oscillation signal by discrete Fourier transformation, and wherein the determined reference values as a function of the associated compression ratios are stored in reference value maps.

* * * * *